United States Patent [19]

Uehara et al.

[11] Patent Number: 4,658,890

[45] Date of Patent: Apr. 21, 1987

[54] ROTARY BLADE TYPE FLUID CONDENSER

[75] Inventors: Haruo Uehara; Tsutomu Nakaoka, both of Saga, Japan

[73] Assignee: Saga University, Saga, Japan

[21] Appl. No.: 722,367

[22] Filed: Apr. 12, 1985

[30] Foreign Application Priority Data

Apr. 17, 1984 [JP] Japan ..... 59-75790

[51] Int. Cl.[4] ..... F28B 1/00; F28F 5/00

[52] U.S. Cl. ..... 165/92; 165/110

[58] Field of Search ..... 165/92, 110

[56] References Cited

U.S. PATENT DOCUMENTS

| | | | |
|---|---|---|---|
| 201,704 | 3/1878 | Sahlfeld | 165/92 |
| 1,689,189 | 10/1928 | Broadhurst | 165/92 |
| 2,332,387 | 10/1943 | Martin | 165/92 |
| 2,453,718 | 11/1948 | Mason et al. | 165/92 |
| 2,458,440 | 1/1949 | Stafford | 165/92 X |
| 2,711,881 | 6/1955 | Rose | 165/92 |
| 3,800,865 | 4/1974 | Onarheim et al. | 165/92 |
| 3,884,294 | 5/1975 | Lödige | 165/92 |
| 3,951,206 | 4/1976 | Williams et al. | 165/92 |
| 4,301,860 | 11/1981 | Pozzi | 165/92 X |

FOREIGN PATENT DOCUMENTS

| | | | |
|---|---|---|---|
| 473878 | 3/1929 | Fed. Rep. of Germany | 165/92 |
| 0053695 | 4/1980 | Japan | 165/92 |
| 287861 | 12/1970 | U.S.S.R. | 165/92 |
| 0626342 | 9/1978 | U.S.S.R. | 165/92 |

*Primary Examiner*—Albert W. Davis, Jr.
*Assistant Examiner*—Randolph A. Smith
*Attorney, Agent, or Firm*—Spencer & Frank

[57] ABSTRACT

A condenser is provided with a heat exchanger which is rotated in an airtight cylindrical vessel filled with a fluid to be condensed. The rotated heat exchanger has a structure almost similar to a rotor of a steam turbine, namely, has a structure formed of plural pairs of hollow blades arranged individually opposite to each other on both sidewalls of an elongated rectangular hollow axle rotated in the fluid to be condensed, all of those hollows being communicated with each other, so as to circulate a coolant therethrough. As a result, the fluid to be condensed always uniformly contacts with the coolant through surfaces of the blades with an extremely high performance of condensation.

2 Claims, 2 Drawing Figures

ROTARY BLADE TYPE FLUID CONDENSER

BACKGROUND OF THE INVENTION (1) Field of the Invention

The present invention relates to a condenser in which a fluid is evaporated into vapor state on warming, meanwhile the same is condensed into liquid state on cooling, and, particularly, the condensation of distinctly superior performance in comparison with the conventional can be efficiently attained.

(2) Description of the Prior Art

Generally speaking, in an electric power plant in which a motive power is generated by heat exchange effected by the circulation of an actuating fluid in vapor state at high temperature, for instance, a heated steam, a chemical plant in which the refining of materials is effected and the like, a condenser of this kind is indispensably employed. However, in most of the heat transferring sections of the conventional condensers customarily used in these various kinds of plants, cylindrical pipes, whose circumferential surfaces are smooth or rough, or which are fitted with fins, are arranged horizontally or vertically in parallel. So that, as for the conventional condensers having heat transferring (heat exchanging) sections constructed as mentioned above, that is, they are fixedly provided with plural cylindrical pipes, it is extremely difficult that any significant improvement of condensation performance in comparison with the conventional is attained, for reasons as follows.

(1) In the above described situation where cylindrical pipes are horizontally arranged, meandering of an actuating fluid is adopted as the flowing mode thereof for attaining a suitable heat exchange between the actuating fluid in vapor state at high temperature and a coolant, so that the pressure loss is increased.

In addition, when the heat exchange is effected, a large amount of actuating fluid condensed in liquid state is deposited on lower halves of horizontally arranged cylindrical pipes through which the coolant is circulated, so that the heat conduction through those lower halves is lowered and hence can hardly contribute to the heat exchange. Consequently, the coefficient of heat transmission is extremely decreased.

(2) In the above described situation where cylindrical pipes are vertically arranged, as the actuating fluid is circulated upwards and downward along a surface on which those pipes are vertically arranged, thick films of actuating fluid condensed in liquid state are deposited on lower halves of those vertically arranged pipes, so that the performance of heat exchange for condensation is extremely deteriorated similarly as mentioned in the above item (1).

(3) As for the conventional condenser having the heat transferring (heat exchanging) section consisting of those pipes as described above, an extremely large number of manufacturing processes and a remarkably high cost are required for manufacturing and installing those heat transferring pipes, as well as for punching a punched partition plate on which those pipes are fitted in the heat exchanging section and for assembling the whole condenser.

(4) Many of heat transferring pipes are fixedly arranged and hence drops of actuating liquid formed on upper pipes drip on lower pipes so that the coefficient of heat transmission for condensation is abruptly lowered.

(5) In place of the above conventional multi-pipe type condenser, a plate type condenser has been recently provided. However, the conventional condenser of this recent type has a remarkably large coefficient of heat transmission in comparison with that of old type, meanwhile the pressure of coolant circulated therethrough is extremely increased.

Consequently, all of conventional condensers of the previously described kinds have various shortcomings respectively in spite of the types thereof and hence cannot efficiently attain the condensation of excellent performance.

SUMMARY OF THE INVENTION

An object of the present invention is to obviate the above conventional shortcomings.

Another object of the present invention is to provide a condenser in which the configuration of the heat exchanging section of the plate type results in a distinctly excellent performance of condensation in comparison with that of older type and, in addition, the pressure loss in the circulation of fluid is reduced, and hence the condensation of high performance can be efficiently attained together with the advantage of simple manufacturing.

For attaining the above described objects, the condenser according to the present invention comprises an airtight cylindrical vessel including radial end plates and having, at radially opposite locations, an inlet and an outlet for a first fluid; and a rotary axle extending through the cylindrical vessel coaxially therewith and being supported in the end plates. A plurality of pairs of hollow blades are mounted on the axle in an axial series for rotation with the axle as a unit. The hollow blades forming one pair extend in opposite directions radially away from the axle. Each hollow blade defines an inner space and each hollow blade includes a partition extending radially from the axle and dividing the inner space into juxtapositioned first and second chambers communicating with one another in a radially outermost zone of the hollow blade. An inlet pipe and an outlet pipe for the second fluid extend adjacent and parallel to the axle and are provided with a series of apertures along their length. Each first chamber is in communication with at least one aperture of the inlet pipe and each second chamber is in communication with at least one aperture of the outlet pipe for providing a flow path for the second fluid. The flow path leads into each first chamber directly from the inlet pipe and into the outlet pipe directly from each second chamber.

BRIEF DESCRIPTION OF THE DRAWINGS

For the better understanding of the invention, reference is made to the accompanying drawings, in which.

Throughout different views of the drawings, 1 is an airtight cylindrical vessel; 2 is an inlet for an actuating fluid; 3 is an outlet for the actuating fluid; *4a, 4b* are both end plates, 5 is a rotating axle; *5a* is an airtight elongated rectangular vessel; *6a, 6b* are narrow tablet shaped hollow blades; 7 is a coupler; 8 is an introducing pipe (inlet pipe); 9 is an exhausting pipe (outlet pipe); 10, 11 are halved hollows (chambers); 12 is a partition plate; A, B are airtightly penetrated portions; and M is a motor.

DESCRIPTION OF THE PREFERRED EMBODIMENT

Figure 1:
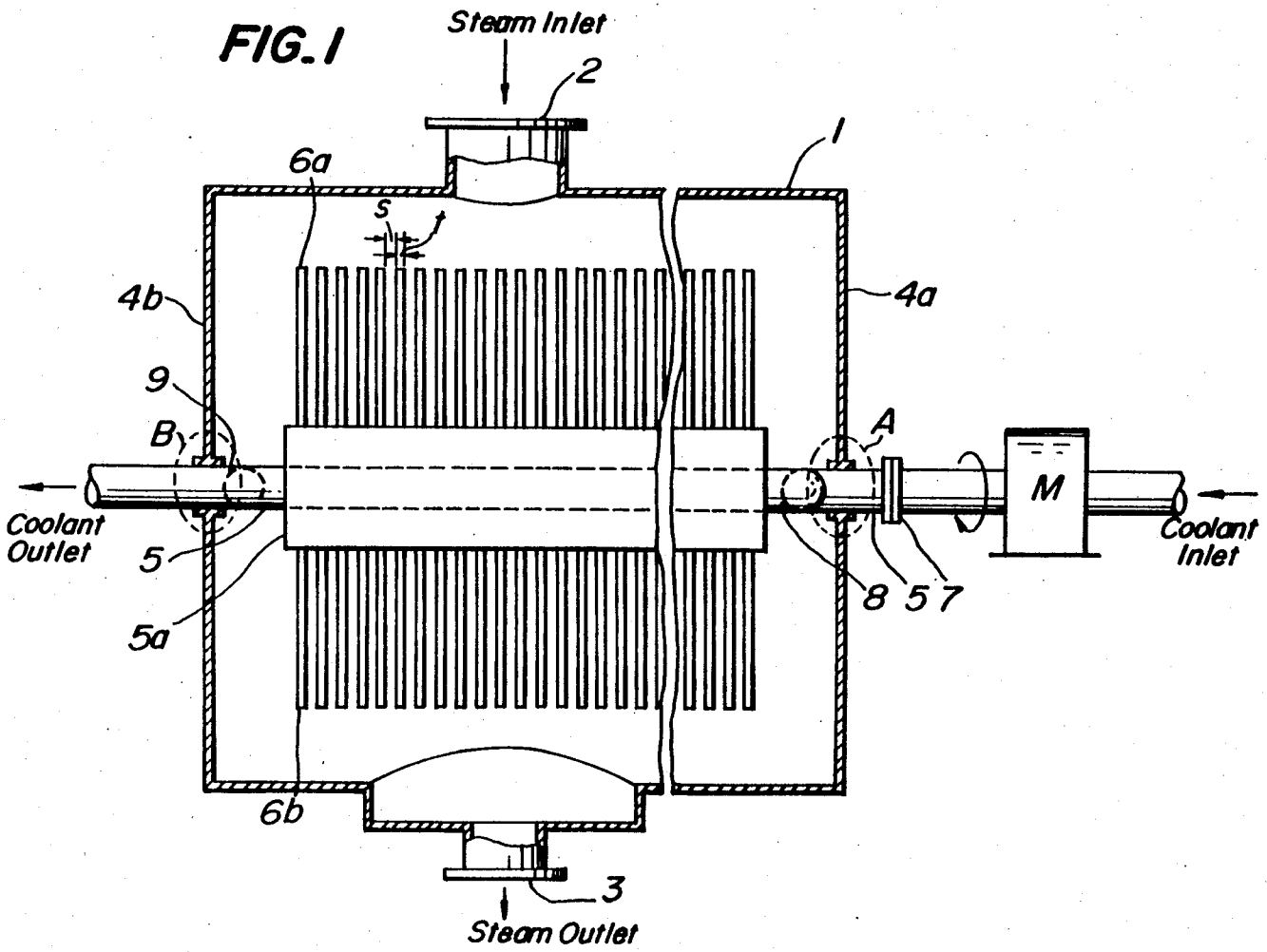
FIG. 1 is a side cross section schematically showing a preferred embodiment of the condenser according to the present invention.
Figure 2:
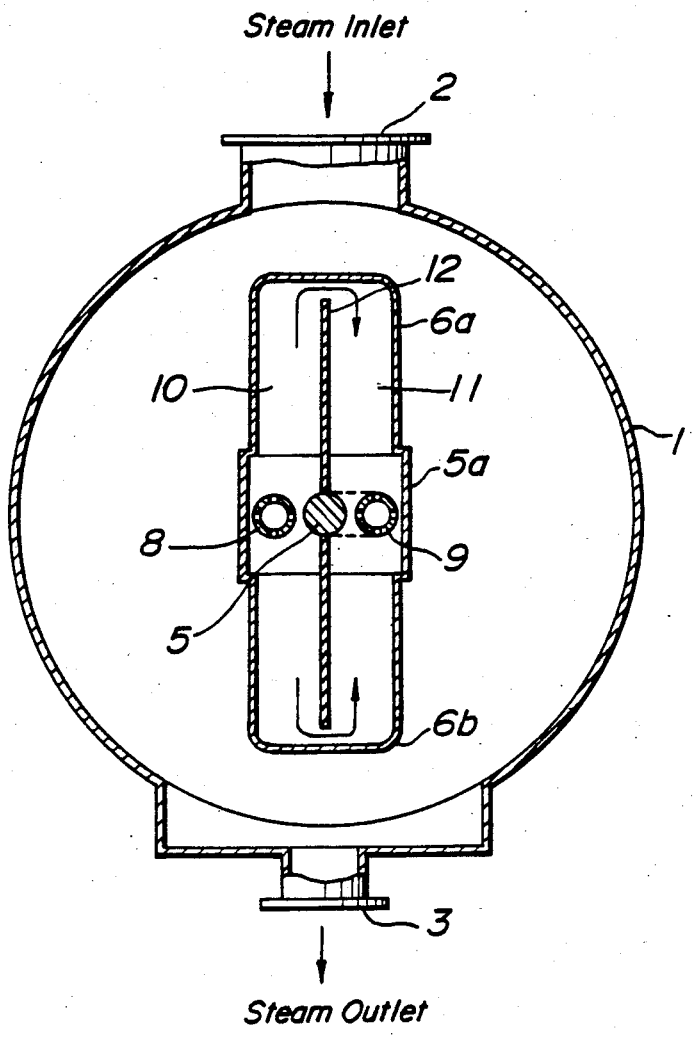
FIG. 2 is a front cross section schematically showing the same.

In the condenser according to the present invention as shown in FIGS. 1 and 2, on a peripheral surface, for instance, on an upper central portion of an airtight cylindrical vessel 1, a central axis of which is horizontally arranged, an inlet 2 for an actuating fluid in vapor state at high temperature, for instance, a steam is provided, while, for instance, on a lower central portion thereof, an outlet 3 for the actuating fluid condensed into liquid state, for instance, the warm water is provided opposite to the above inlet 2, so as to circulate the actuating fluid through the airtight cylindrical vessel in the filled state.

A rotating axle 5 is coaxially provided such that a central axis thereof coincides with a central axis of the airtight cylindrical vessel 1 formed as described above and both end portions of the former airtightly penetrate both end plates 4*a*, 4*b* of the latter respectively, so as to facilitate the rotation of the former inside the latter under the external driving. In this connection, airtightly penetrated portions A, B as indicated by surrounding broken circles in FIG. 1 are arranged such that the leakage therethrough of the aforesaid actuating fluid can be prevented by employing mechanical seals or oil seals.

An airtight vessel 5*a* having a preferably rectangular cross section is provided inside the airtight cylindrical vessel 1 around and along the rotating axle 5 formed as described above. A great number of narrow tablet shaped hollow blades 6*a* and 6*b* are fitted serially, for instance, on an upper side surface and a lower side of the vessel 5*a* opposite to each other individually. These narrow tablet shaped blades 6*a* and 6*b* are densely arranged, for instance, with a thickness of 2 mm at an interval of 3 mm and further with a width and a length being suitable for being rotated inside the cylindrical vessel 1 on the axis of the axle 5 and for being efficiently kept in contact with the actuating fluid filling the cylindrical vessel 1. In addition, inner hollows of each narrow tablet shaped blades 6*a*, 6*b* are communicated with an inner hollow of the elongated rectangular vessel 5*a*. However, whole spaces of those hollows are not simply communicated with each other, but are arranged such that the actuating fluid pressure-supplied from an end portion of the elongated rectangular vessel 5*a* is exhausted from the other end portion thereof after uniformly circulated through the whole inner hollows of all blades 6*a*, 6*b*, for instance, as described as follows.

Firstly, for example, as shown in FIG. 2, a partition plate 12 perpendicular to the rotating axle 5 is provided such that the respective inner hollows are longitudinally divided which hollows (chambers) are fitted opposite to each other on both of upper and lower side surfaces of the elongated rectangular vessel 5*a* and communicated with each other, so as to halve those mutually communicated inner hollows, for instance, into left and right half hollows (chambers) 10 and 11 as shown in FIG. 2. The plane of the partition 12 contains the longitudinal central axis of the axle 5. Both top portions of these half hollows 10 and 11 are communicated with each other inside the blades 6*a* and 6*b*. In addition, an introducing pipe (inlet pipe) 8 and an exhausting pipe (outlet pipe) 9 provided, for instance, with plural perforations through peripheral walls thereof are fixedly arranged in parallel with the rotating axle 5 penetrating inside of the elongated rectangular vessel 5*a* and extending along substantially the full length thereof. Inner hollows are formed inside the rotating axle 5, for instance, on both portions at which the axle 5 penetrates the both end plates 4*a* and 4*b* of the cylindrical vessel 1. One of these inner hollows is communicated with the introducing pipe 8, meanwhile the other thereof is communicated with the exhausting pipe 9, so as to communicate these hollows formed inside the rotating axle 5 with coolant reservoirs (not shown) provided externally in the vicinity of the airtight cylindrical vessel 1. In this connection, the axle 5 is coupled with a motor M by a coupler 7 provided on one end of the axle 5, so as to be rotated at a required suitable speed.

As described above, a path for circulating the coolant (which path is separated from the inner hollow of the airtight cylindrical vessel 1 filled with the actuating fluid to be condensed is formed inside the cylindrical vessel 1. By means of pressure-supplying the coolant into the coolant reservoir (not shown) communicated with the introducing pipe 8 through this path for circulating the coolant, the coolant is pressure-supplied into the introducing pipe 8 through the inner hollow formed inside the end portion of the rotating axle 5, and thereafter is introduced into the chamber 10 by being uniformly discharged through the plural perforations provided through the peripheral wall of the introducing pipe 8. Then the coolant is introduced into the chamber 11 inside the blades 6*a*, 6*b*, and flows thereafter into the exhausting pipe 9 through the plural perforations provided through the peripheral wall thereof. Then the coolant is guided into the other coolant reservoir through the inner hollow inside the other end portion of the rotating axle 5. By virtue of this circulation of the coolant, heat exchange is effected between the coolant and the actuating fluid in vapor at high temperature which internally and externally contact the walls of the blades 6*a*, 6*b* respectively, and hence the actuating fluid in vapor state at high temperature which is introduced from the inlet 2 is withdrawn from the outlet 8 after condensed into liquid state. It is preferable that the walls of the blades 6*a*, 6*b* are formed as groove shaped flutes or undulatory rugged surfaces rather than as smooth surfaces, so as to facilitate an efficient heat exchange. In addition, the blades used for condensing the actuating fluid through this heat exchange is rotated at an appropriate speed, so that the actuating fluid condensed into liquid state does not adhere to the surfaces of the blades, but is scattered in all directions by the centrifugal force. Accordingly, the actuating fluid in vapor state at high temperature always directly contacts all surfaces of the blades used for the heat exchange, and hence the heat transmission coefficient of condensation can be remarkably increased at least by two times, or more than by ten times in comparison with structures where the blades are stationary or other conventional plate type heat exchangers. Moreover, where the condensation is effected through rotating blades, the pressure loss caused in the actuating fluid in vapor state is substantially equal to zero, and further, the coolant circulated inside those blades is affected by the centrifugal force. As a result, the pressure loss can be extremely reduced.

The structure of the condenser according to the present invention, and particularly, the circulating path for the coolant is not restricted to the above example as shown in the drawings, but can be realized under the various modifications as occasion demands, so far as the coolant is uniformly circulated through the heat exchanger constructed of the rotating blades.

As is apparent from the above description, according to the present invention, with respect to the condenser, particularly, provided with the plate type heat exchanger which has been regarded as having a high efficiency, the following remarkably excellent performance of condensation in comparison with the conventional can be obtained:

(1) The heat transferring plate is rotated, so as to scatter the condensed liquid, so that it is possible to realize an extremely high heat transmission coefficient of condensation which may be two to ten times the value as compared with that in stationary situation.

(2) Regarding the substance (coolant) for extracting the heat from the fluid which is in vapor state and which is to be condensed, a large heat transfer coefficient can also be realized.

(3) The pressure loss of the fluid in vapor state to be condensed at the inlet of the condenser is small, so that the pumping power required for circulating the fluid in vapor state is extremely reduced in comparison with conventional arrangements.

(4) Both of heat transmission coefficients of the fluids to be heated and to be used for heating are high, so that the whole occupied volume of the condenser provided with the heat exchanger as the main part thereof is extremely reduced in comparison with conventional structures.

What is claimed is:

1. A condenser for converting a first fluid from a vapor state into a liquid state by heat exchange with a second fluid, comprising (a) an airtight cylindrical vessel including radial end plates and having an inlet and an outlet for the first fluid;

(b) a rotary axle extending through said cylindrical vessel coaxially therewith and being supported in said end plates;

(c) an elongated hub casing coaxially surrounding said axle and affixed thereto for rotation therewith as a unit; an inlet pipe and an outlet pipe for the second fluid, extending adjacent and parallel to said axle apart from each other on opposite sides of a plane containing an axis of said axle, being provided with a plurality of apertures distributed respectively on their peripheral walls along their length and being enclosed by said hub casing;

(d) a plurality of pairs of hollow blades mounted on said elongated hub casing in an axial series for rotation with said axle as a unit; the hollow blades forming one pair extending in opposite directions radially away from said axle; each said hollow blade defining an inner space; each said hollow blade including a partition plate extending radially from said axle in said plane through said hub casing and dividing the inner space of each hollow blade into juxtapositioned first and second chambers communicating with one another in a radially outermost zone of the hollow blade and dividing the inner space of said hub casing into juxtapositioned first and second channels; each said first chamber being evenly in communication with a plurality of respective apertures of said inlet pipe by means of said first channel and each said second chamber being evenly in communication with a plurality of respective apertures of said outlet pipe by means of said second channel for providing for a flow path for said second fluid, leading into each said first chamber evenly from said inlet pipe and further leading into said outlet pipe evenly from each said second chamber; and (e) motor means for rotating said axle.

2. A condenser as defined in claim 1, wherein said inlet and said outlet are provided in said cylindrical vessel at radially opposite locations thereof.

* * * * *